US008869319B2

(12) United States Patent
Griffin et al.

(10) Patent No.: US 8,869,319 B2
(45) Date of Patent: Oct. 28, 2014

(54) CIRCULAR SUCTION OUTLET ASSEMBLY AND COVER

(75) Inventors: Ronald H. Griffin, Boonville, NC (US); Robert Rung, Hopatcong, NJ (US)

(73) Assignee: Hayward Industries, Inc., Elizabeth, NJ (US)

( * ) Notice: Subject to any disclaimer, the term of this patent is extended or adjusted under 35 U.S.C. 154(b) by 1329 days.

(21) Appl. No.: 11/520,399

(22) Filed: Sep. 13, 2006

(65) Prior Publication Data

US 2007/0180604 A1 Aug. 9, 2007

Related U.S. Application Data

(60) Provisional application No. 60/716,545, filed on Sep. 13, 2005.

(51) Int. Cl.
*E04H 4/00* (2006.01)
*E04H 4/12* (2006.01)
*E04H 4/14* (2006.01)

(52) U.S. Cl.
CPC ..... *E04H 4/1236* (2013.01); *E04H 4/14* (2013.01)
USPC ..... 4/507

(58) Field of Classification Search
CPC ..... E04H 4/1236; E04H 4/14
USPC ..... 4/204, 507, 510, 512, 679, 688, 689, 4/286, 293, 294, 287, 295; D24/204
See application file for complete search history.

(56) References Cited

U.S. PATENT DOCUMENTS

| | | | | | |
|---|---|---|---|---|---|
| 2,095,024 | A | * | 10/1937 | Boosey | 210/300 |
| 2,701,027 | A | | 2/1955 | Scoville | |
| D191,184 | S | | 8/1961 | Scholz | |
| 3,321,080 | A | * | 5/1967 | Pansini et al. | 4/290 |
| 3,725,964 | A | * | 4/1973 | Whitsett | 4/679 |
| 3,940,807 | A | | 3/1976 | Baker et al. | |
| 4,276,163 | A | | 6/1981 | Gordon | |
| 4,402,094 | A | | 9/1983 | Sanders | |
| D290,166 | S | | 6/1987 | Jacuzzi | |
| D299,522 | S | | 1/1989 | Chalberg | |
| D300,558 | S | | 4/1989 | Warnekros | |
| D319,295 | S | | 8/1991 | Ohaus | |
| 5,167,041 | A | * | 12/1992 | Burkitt, III | 4/509 |

(Continued)

OTHER PUBLICATIONS

U.S. Appl. No. 29/327,789, entitled: "Circular Suction Outlet Assembly Cover Design," filed Nov. 13, 2008 (6 pages).

(Continued)

*Primary Examiner* — Tuan N Nguyen
(74) *Attorney, Agent, or Firm* — McCarter & English, LLP

(57) ABSTRACT

A circular suction outlet assembly is provided for use in swimming pools, spas, and the like, which includes a sump body having a central stem which forms an annular space within the sump body, and a nozzle which communicates with the annular space to convey water to the swimming pool drain circuit. A circular, domed-shaped cover is removeably fitted to the top of the sump body. Safety features of the suction outlet assembly include openings in the cover arranged to allow a bather to safely break a seal formed between a body part and the cover. In the event the cover becomes separated from the sump body, the annular space and the central stem also inhibit the insertion and entrapment of human body parts in the sump body.

8 Claims, 8 Drawing Sheets

(56) References Cited

U.S. PATENT DOCUMENTS

| | | | | |
|---|---|---|---|---|
| D344,325 | S | 2/1994 | Chalberg | |
| D363,768 | S | 10/1995 | Morgan | |
| 5,499,406 | A * | 3/1996 | Chalberg et al. | 4/504 |
| D377,389 | S | 1/1997 | Phillips et al. | |
| 5,734,999 | A | 4/1998 | Nicholas | |
| 5,978,981 | A | 11/1999 | Nelson | |
| 6,023,795 | A * | 2/2000 | Potter et al. | 4/652 |
| 6,038,712 | A * | 3/2000 | Chalberg et al. | 4/507 |
| 6,088,842 | A | 7/2000 | Barnett | |
| 6,170,095 | B1 | 1/2001 | Zars | |
| 6,341,387 | B1 | 1/2002 | Zars | |
| 6,374,854 | B1 | 4/2002 | Acosta | |
| 6,393,631 | B2 | 5/2002 | Schroader | |
| 6,397,408 | B1 | 6/2002 | Veloskey et al. | |
| 6,442,774 | B2 * | 9/2002 | Wilson et al. | 4/504 |
| 6,453,482 | B1 | 9/2002 | Mullings | |
| D466,198 | S | 11/2002 | Mullings | |
| 6,588,029 | B2 * | 7/2003 | Mullings | 4/507 |
| 6,637,464 | B1 | 10/2003 | Cornwall | |
| D485,889 | S | 1/2004 | DuBois | |
| 6,738,994 | B2 | 5/2004 | Barnett et al. | |
| 6,817,043 | B2 | 11/2004 | Zars | |
| 6,944,893 | B1 * | 9/2005 | Mattson et al. | 4/541.1 |
| 7,122,117 | B1 * | 10/2006 | Goldring et al. | 4/286 |
| 7,140,051 | B2 * | 11/2006 | Fort et al. | 4/509 |
| D581,723 | S | 12/2008 | Pan | |
| 2004/0139541 | A1 | 7/2004 | Barnett | |
| 2007/0180605 | A1 | 8/2007 | Griffin et al. | |

OTHER PUBLICATIONS

*Ex Parte Quayle* Action dated Jun. 11, 2009 from U.S. Appl. No. 29/327,789, filed Nov. 13, 2008, which claims priority from parent U.S. Appl. No. 11/520,399, filed Sep. 13, 2006 (10 pages).

U.S. Appl. No. 11/520,499, entitled "Elongated Suction Outlet Assembly with Intrinsically Safe Sump", (filed Sep. 13, 2006), Inventors: Ronald H. Griffin, et al.

* cited by examiner

CIRCULAR SUCTION OUTLET ASSEMBLY AND COVER

CROSS REFERENCE TO RELATED APPLICATION

This application claims priority of U.S. Provisional Patent Application Ser. No. 60/716,545 filed Sep. 13, 2005, the disclosure of which is incorporated by reference herein in its entirety.

FIELD OF THE INVENTION

The present invention relates to suction outlet assemblies and, more particularly, to such assemblies adapted for use in swimming pools and spas.

BACKGROUND OF THE INVENTION

A conventional water circulation system for a swimming pool is equipped with a suction outlet formed in the floor or wall of the pool. The suction outlet is connected to a suction pipe which is attached to a pump or gravity flow collector vessel. Water is thereby drawn into the circulation system through the suction outlet. For safety reasons, the suction outlet is typically covered with a perforated cover in order to prevent large objects, such as human body parts, from being sucked into the suction outlet.

Conventional covers and their underlying suction outlets have various shortcomings and disadvantages. For example, if a bather completely obstructs the perforated cover, there is a risk that human body parts can be undesirably held against the suction outlet, raising the possibility of drowning. Further, if the cover is accidentally displaced from the suction outlet, human body parts can be drawn into the exposed suction outlet or piping. In such circumstances, there is a need for a suction outlet assembly that includes safety features for the cover and the suction outlet.

SUMMARY OF THE INVENTION

The present invention overcomes the disadvantages and shortcomings discussed above by providing a new and improved suction outlet assembly, which is equipped with various safety features. For example, the suction outlet assembly includes a stem that serves to limit access to the outlet pipe. A perforated cover is dome shaped in order to inhibit bathers from completely blocking all of the openings formed in the cover. Further, the suction outlet assembly can optionally be provided with a hydrostatic relief valve which is used to relieve hydrostatic pressure, thereby preventing the buildup of excessive ground water pressure underneath the swimming pool which could float the pool. Another feature is a test cap used to perform hydrostatic pressure testing of the suction outlet assembly and circulation system piping.

BRIEF DESCRIPTION OF THE DRAWINGS

For a more complete understanding of the present invention, reference is made to the following detailed description of various exemplary embodiments of the present invention considered in conjunction with the accompanying drawings, in which.

DETAILED DESCRIPTION OF THE EXEMPLARY EMBODIMENTS

Figure 1:
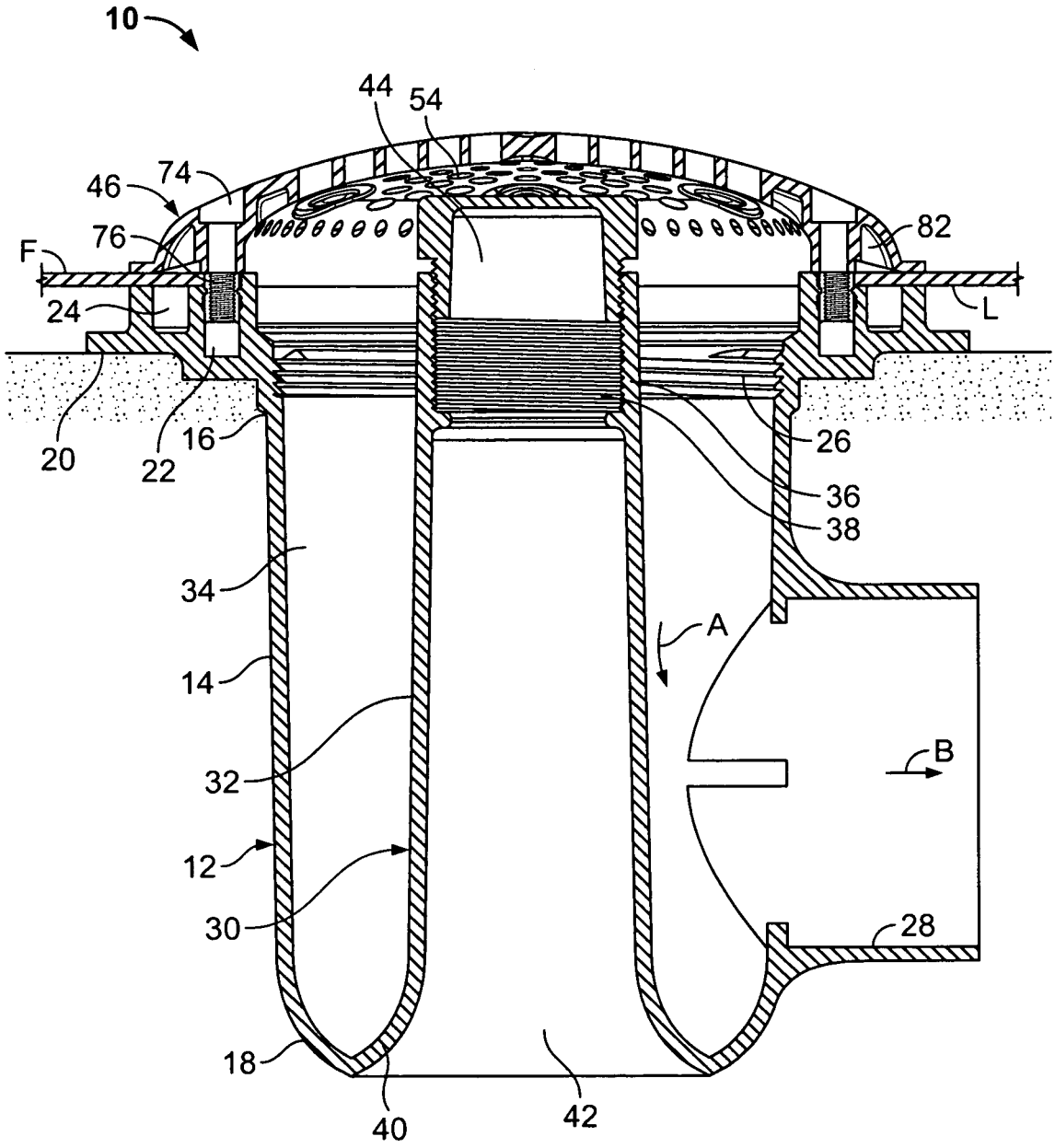
FIG. 1 is a cross-sectional view of a suction outlet assembly which includes a removable cover and a plug, and which has been constructed in accordance with a first exemplary embodiment of the present invention.

Referring to FIG. 1, a suction outlet assembly 10 is adapted for mounting in a floor (F) or wall of a swimming pool. The suction outlet assembly 10 includes a cup-shaped sump body 12 having an outer wall 14 with an upper end 16 and a lower end 18. The sump body 12 also has a flange 20 that extends outwardly from the upper end 16 of the outer wall 14. A first set of apertures 22 is formed in the flange 20 for reasons to be described hereinafter, and a second set of apertures 24 is formed in the flange 20 to secure a clamping member (not shown) for membrane pool liners (e.g., a vinyl liner (L)). The sump body 12 has internal threads 26 for purposes to be discussed hereinafter. A nozzle 28 is formed in the outer wall 14 of the sump body 12 and is provided for discharging water flowing through the sump body 12 to a pump (not shown).

With continued reference to FIG. 1, the suction outlet assembly 10 also includes a central stem 30 having a substantially cylindrical, elongated wall 32 which is positioned within the outer wall 14 of the sump body 12. In other words, the wall 32 of the central stem 30 has a diameter which is less than the diameter of the outer wall 14 of the sump body 12. As a result of their generally coaxial arrangement, the wall 32 of the central stem 30 and the outer wall 14 of the sump body 12 cooperate to form an annular space 34 therebetween. The central stem 30 has an upper end 36 with internal threads 38 for purposes to be discussed hereinafter. The central stem 30 has a lower end 40 which curves outwardly toward the sump body 12 and is integrally formed with the lower end 18 of the sump body 12. A bore 42 is formed in the central stem 30, extending along the entire length thereof. Still referring to FIG. 1, a plug 44 threadedly engages the internal threads 38 formed on the upper end 36 of the central stem 30 so as to seal the top end of the bore 42. As will be described in further detail hereinafter, the central stem 30 is employed for safety reasons and also provides a flow path for ground water.

With reference to FIGS. 1-4, the suction outlet assembly 10 is also provided with a cover 46 adapted to be removably secured to the flange 20 of the sump body 12 (see FIG. 1). The cover 46 is substantially circular and is dome-shaped (i.e., non-planar). The cover 46 has a top surface 48 (see FIG. 3) and a bottom surface 50 (see FIG. 4). As most clearly shown in FIG. 2, a central section 52 of the cover 46 is perforated with a plurality of openings 54 (see FIGS. 2-4) permitting passage of pool water therethrough. The cover 46 includes a small solid center 56 to facilitate injection molding. The openings 54 have an asterisk-shaped pattern such that a plurality of substantially unperforated sections 58 (see FIGS. 2 and 3) is formed along the periphery of the central section 52 and an opening 60 (see FIGS. 2-4) is formed in each of the unperforated sections 58. The positional arrangement of the openings 54 and the unperforated sections 58 enhances the ability of an entrapped bather to peel an article of clothing, such as a swimsuit, or body part off the cover 46 if differential pressure is developed. The cover 46 also has a downwardly curved side portion 62 (see FIGS. 2 and 3) and a circular flange or lip 64 which extends outwardly from the side portion 62 of the cover 46. The lip 64 is sized and shaped so as to provide a location for informative lettering.

Figure 2:
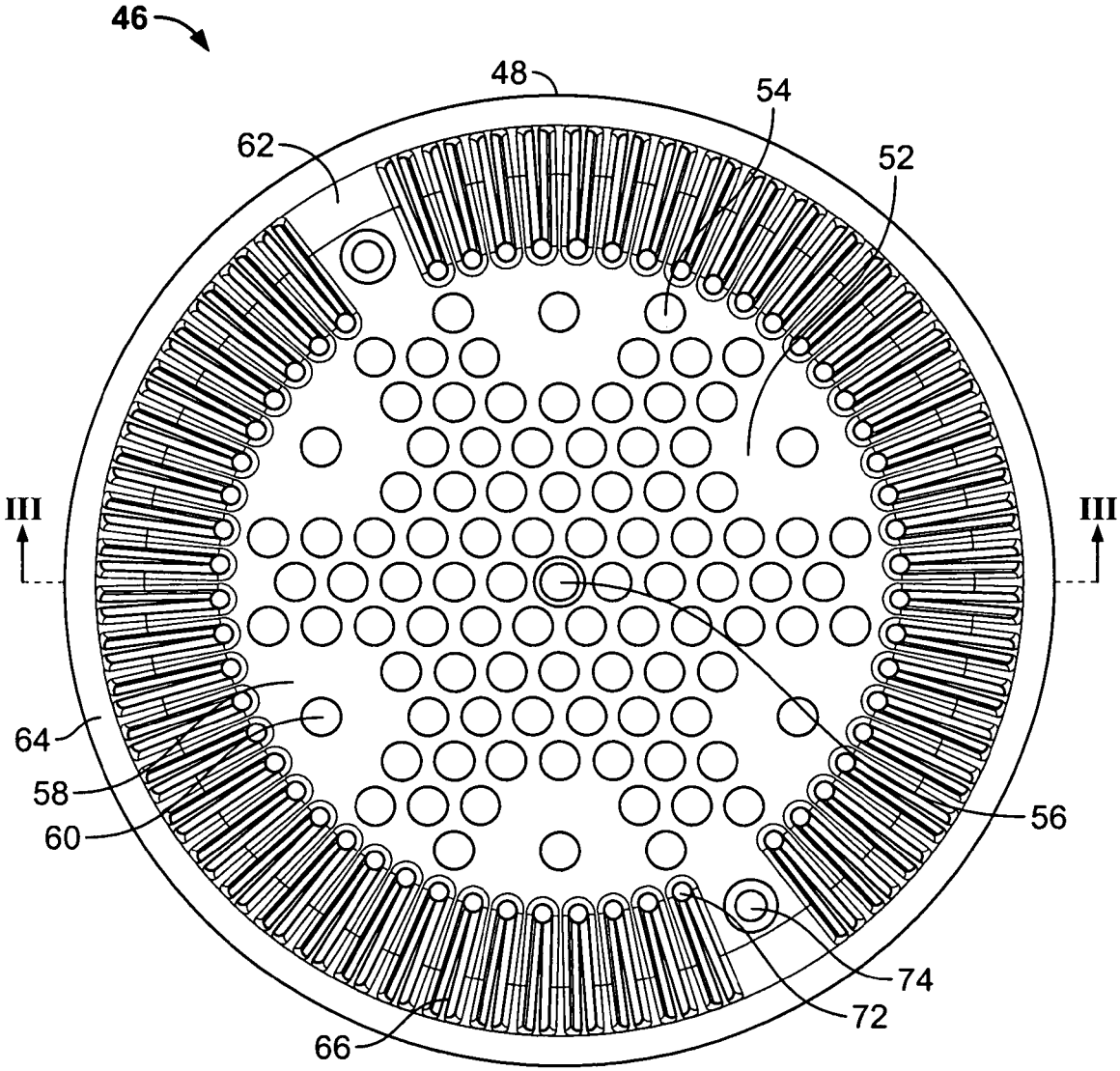
FIG. 2 is a top view of the cover shown in FIG. 1.
Figure 3:
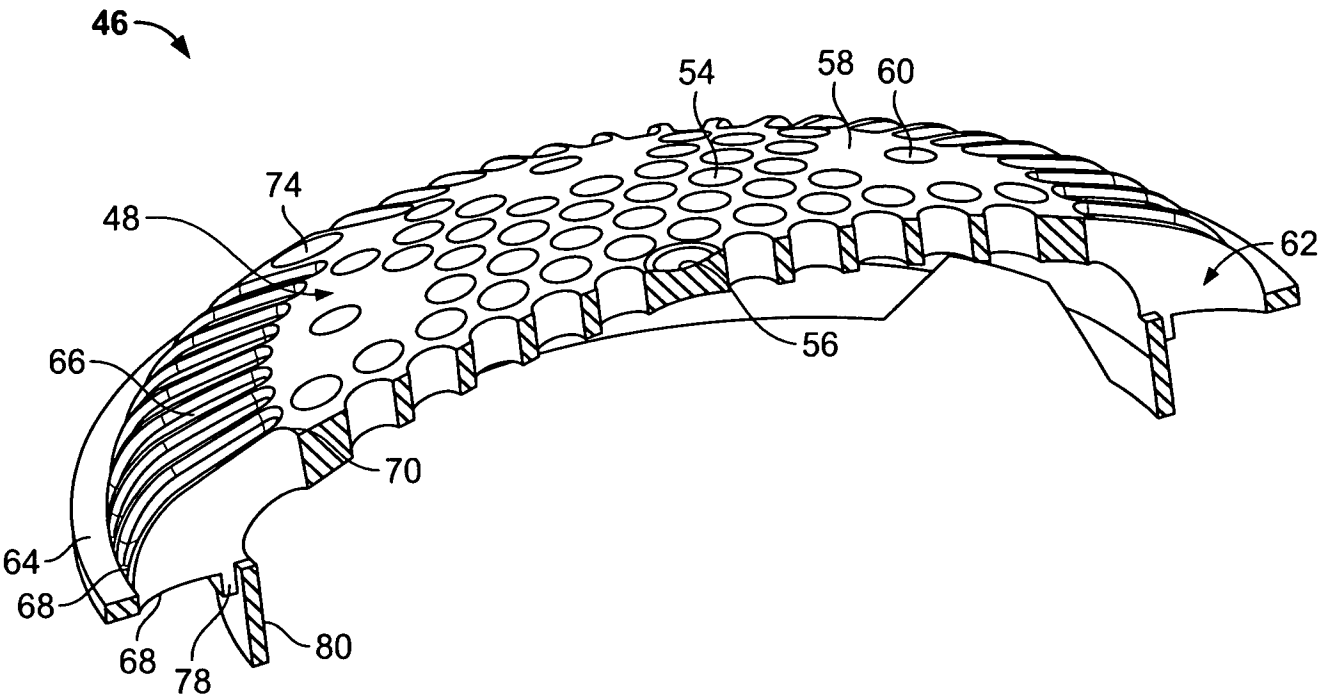
FIG. 3 is a perspective sectional view, taken along section line III-III of FIG. 2 and looking in the direction of the arrows, of the cover shown in FIG. 2.
Figure 4:
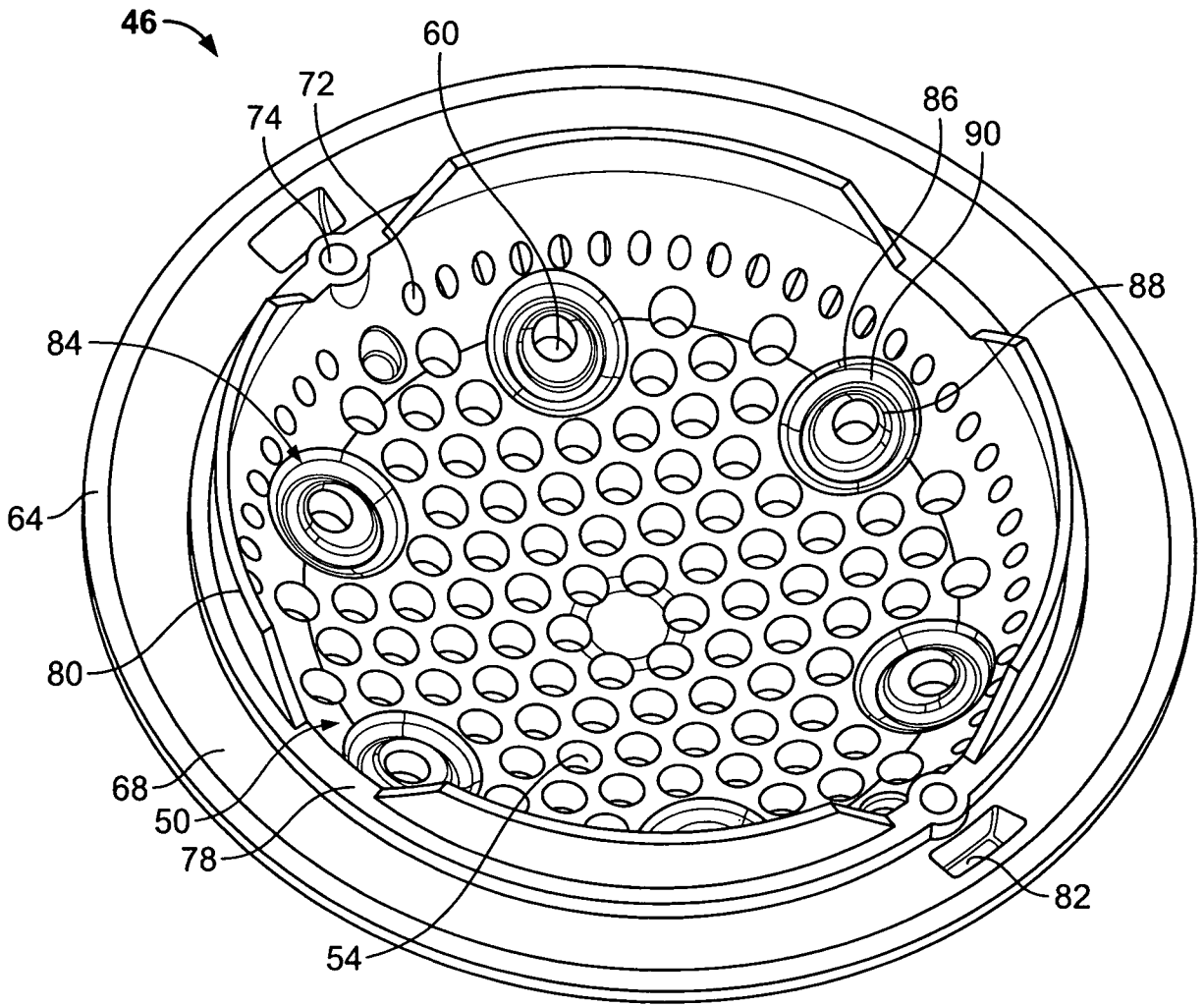
FIG. 4 is a bottom perspective view of the cover shown in FIG. 2.

Referring to FIGS. 2-4, the side portion 62 of the cover 46 includes a plurality of radially extending slots 66 (see FIGS. 2 and 3) and a bottom surface 68. As most clearly shown in FIG. 3, each of the slots 66 has a U-shaped side wall 70 which extends upwardly from the bottom surface 68. The slots 66 are sized and shaped so as to exclude foreign objects that may accumulate around the cover 46. An opening 72 (see FIGS. 2 and 4) is formed in the bottom surface 68 of each of the slots 66. The openings 72 formed in the slots 66 are smaller than the openings 54 and 60 formed in the central section 52 of the cover 46 so as to permit passage of pool water through the openings 72 while inhibiting passage of larger foreign objects contained in the pool water. The pattern of slots 66 is discontinuous such that a set of apertures 74 (see FIGS. 1-4) is formed in the side portion 62 of the cover 46 so as to allow fasteners such as screws (not shown) to be inserted therethrough. The apertures 74 are aligned with a threaded insert 76 formed in the apertures 22 of the flange 20 of the sump body 12 (see FIG. 1), thereby enabling the cover 46 to be removably secured to the sump body 12 by the screws (not shown).

Referring to FIG. 4, the bottom surface 50 of the cover 46 includes an annular lip 78 (see FIGS. 3 and 4) and a plurality of spaced apart protrusions 80 (see FIGS. 3 and 4) which facilitate the placement of the cover 46 on the sump body 12 and provide support for side forces. A pair of cavities 82 (see FIGS. 1 and 4) is formed in the bottom surface 68 and is sized and shaped so as to avoid undesirable thick sections in a plastic injection molding process. Similarly, the bottom surface 50 of the cover 46 also includes a plurality of enlarged circular depressions 84 positioned underneath the unperforated sections 58 (see FIGS. 2 and 3) of the top surface 48 of the cover 46. The depressions 84 surround the openings 60 (see FIGS. 2-4) formed in the unperforated sections 58. Each of the depressions 84 includes an outer wall 86 and an inner wall 88 so as to form a cavity 90 between the outer wall 86 and the inner wall 88.

In operation, pool water flows into the suction outlet assembly 10 through all of the openings 54, 60, and 72 formed in the cover 46 and into the annular space 34 formed between the outer wall 14 of the sump body 12 and the wall 32 of the central stem 30. Thereafter, the pool water flows from the annular space 34 into the nozzle 28 (as indicated by arrow A in FIG. 1). The pool water then flows out of the nozzle 28 (as indicated by arrow B in FIG. 1) to the pump or gravity flow collector vessel.

The present invention provides various safety features for the suction outlet assembly 10. For example, the non-planar shape of the cover 46 makes it difficult for a bather to completely block all of the openings 54, 60, and 72 formed in the cover 46, thereby avoiding entrapment. Accordingly, the dome-shaped cover 46 prevents the development of an unsafe condition which has existed with conventional covers having a flat configuration.

When the cover 46 is not installed in or is accidentally removed from the suction outlet assembly 10, the plug 44 and the central stem 30 are positioned within the sump body 12 so as to limit body area that is exposed to the differential pressure between the pool water and the suction piping, thus minimizing entrapping force. Furthermore, the annular space 34 is narrow such that a bather is inhibited from accessing the nozzle 28 with his or her limb body parts, thereby avoiding entrapment.

Figure 5:
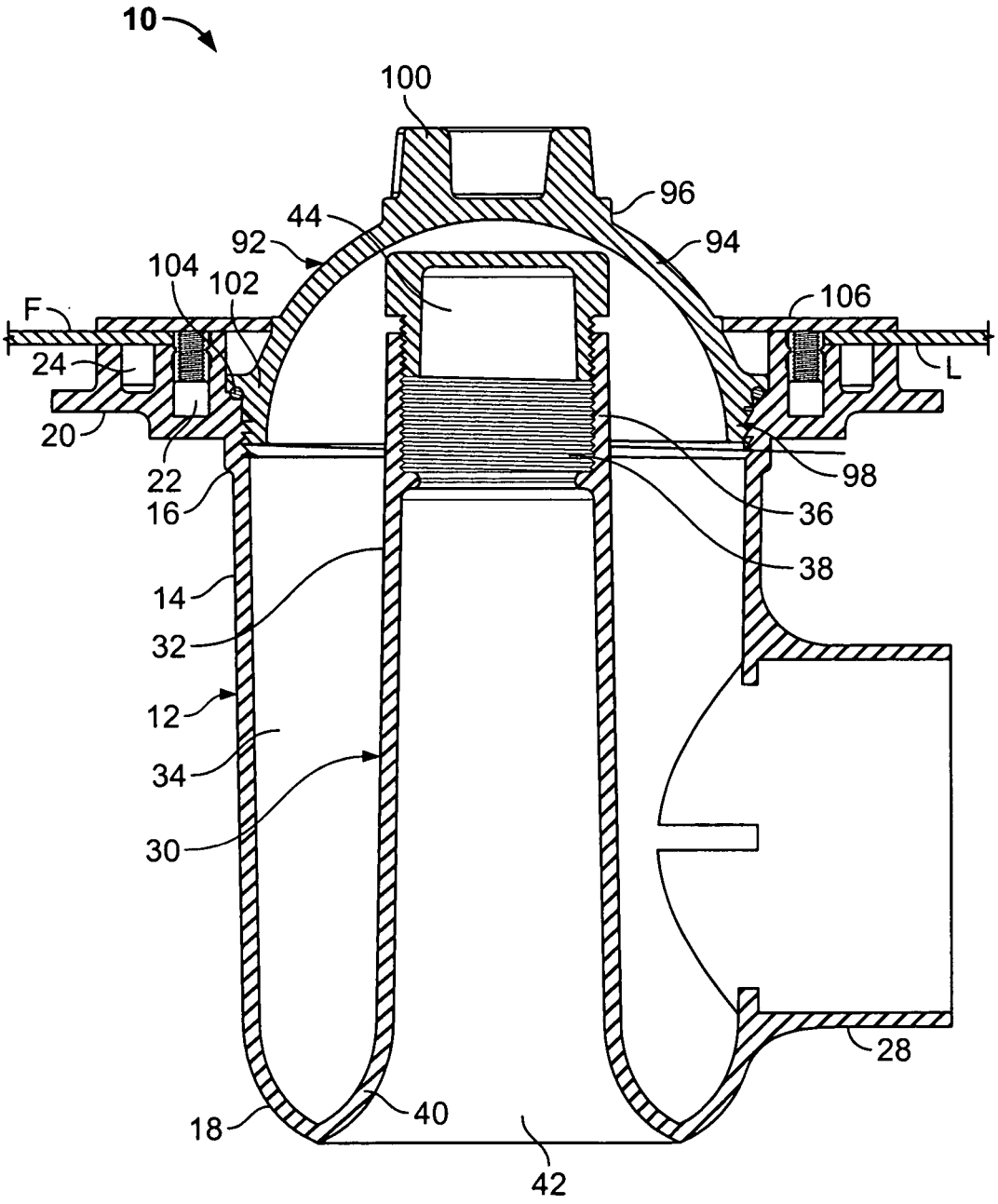
FIG. 5 is a cross-sectional view similar to that of FIG. 1, except that the cover has been removed and replaced by a hydrostatic pressure test cap.

Referring to FIG. 5, with the cover 46 (see FIGS. 1-4) removed from the sump body 12, a test cap 92 may be mounted to the sump body 12 in order to perform hydrostatic pressure testing of the suction outlet assembly 10. The test cap 92 includes a dome-shaped body 94 with a top end 96 and a bottom end 98. The high dome-shaped body 94 insures that the test cap 92 is removed before the cover 46 (see FIGS. 1-4) is installed, thereby preventing mistaken unsafe operation of a dual-outlet pool with one outlet already blocked. The top end 96 includes a nut 100 and the bottom end 98 includes external threads (not shown) which mates with the threads 26 (see FIG. 1) formed on the sump body 12. The bottom end 98 also includes an annular rim 102 sized and shaped so as to compress a sealing component, such as O-ring 104, used to seal the annular rim 102 of the test cap 92 to the flange 20 of the sump body 12. When the test cap 92 is mounted to the sump body 12 as shown in FIG. 5, an annular shield 106 is provided over the flange 20 of the sump body 12 to prevent construction debris, such as concrete overspray, from entering the suction outlet assembly 10.

The test cap 92 may also be used to cover the suction outlet assembly 10 when the swimming pool is not in use for an extended period of time, such as during the winter months. In this manner, the test cap 92 may be used to inhibit the passage of pool water into the suction outlet assembly 10.

Figure 6:
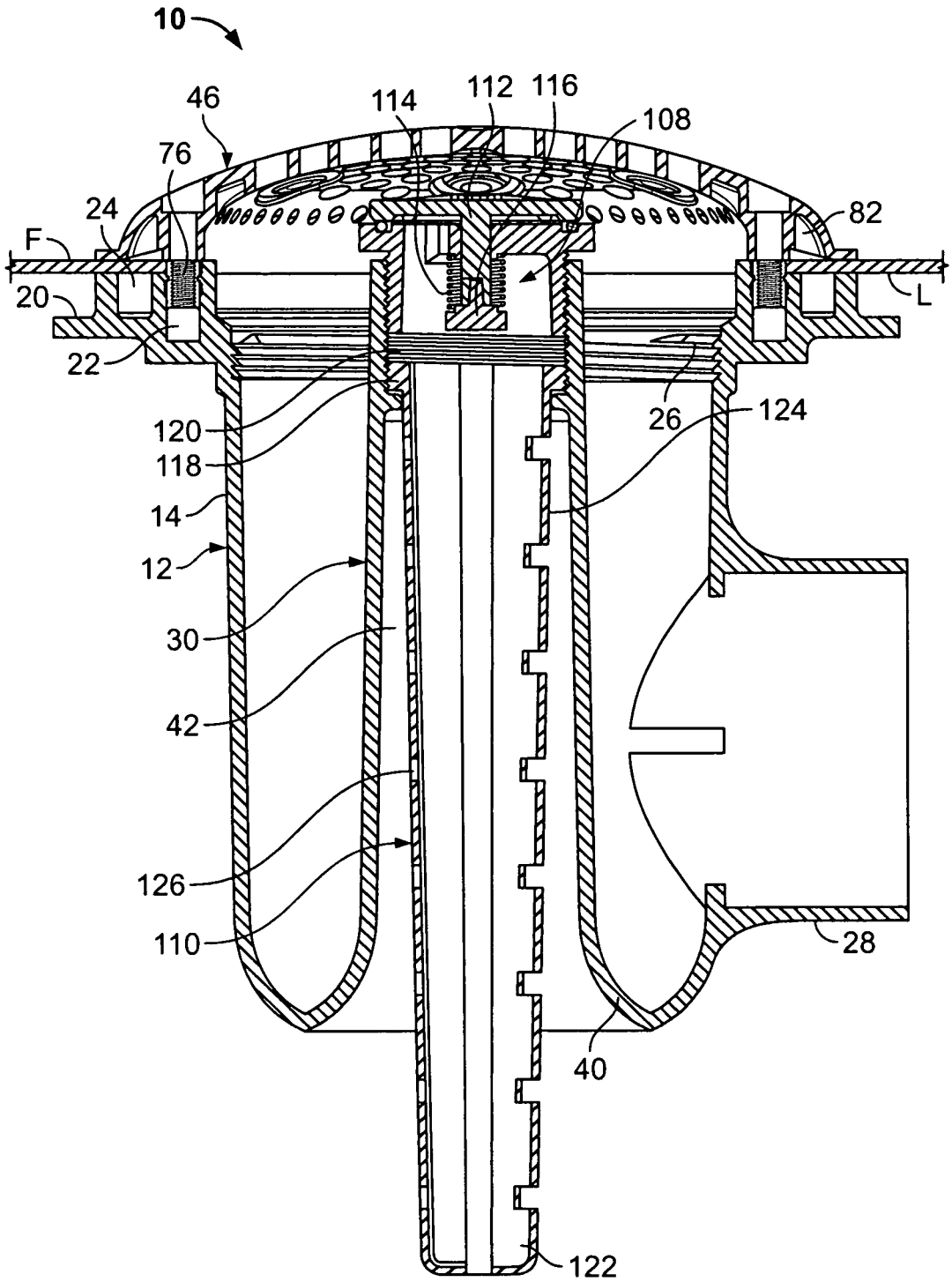
FIG. 6 is a cross-sectional view similar to that of FIG. 1, except that the plug has been replaced with a hydrostatic relief valve and a collector tube.

Referring to FIG. 6, a hydrostatic relief valve 108 and a collector tube 110 are positioned within the sump body 12. More particularly, the hydrostatic relief valve 108 is positioned above the central stem 30, threadedly mates with the internal threads 38 of the central stem 30, and includes a poppet 112 compressed into a seat (not shown) by a spring 114. The hydrostatic relief valve 108 is sized and shaped so as to close off the top end of the bore 42 formed in the central stem 30. A valve stop 116 is attached to the poppet 112. As will be described in further detail hereinafter, the hydrostatic relief valve 108 functions to relieve excessive hydrostatic pressure in the earth around the pool and to allow a partly empty pool to fill with ground water, thereby preventing floatation of the pool structure.

With continued reference to FIG. 6, the collector tube 110 is positioned in the bore 42 formed in the central stem 30. The positional arrangement of the central stem 30 allows the collector tube 110 to be accommodated in the bore 42 with minimum excavation depth. The collector tube 110 has an upper end 118 which includes external threads 120 sized and shaped so as to mate with internal threads 38 formed in the stem 30. The collector tube 110 has a lower end 122 which is positioned below the central stem 30 and the sump body 12. The collector tube 110 has a cylindrical body 124 with spaced grooves 126 sized and shaped so as to allow groundwater, but not soil, to pass therethrough. When the pressure of the groundwater under the suction outlet assembly 10 exceeds the pressure of the water in the swimming pool, by more than the valve cracking pressure, the poppet 112 will be moved from its seat (not shown), thereby permitting groundwater to flow through the grooves 126 formed in the collector tube 110 and into the swimming pool.

Figure 7:
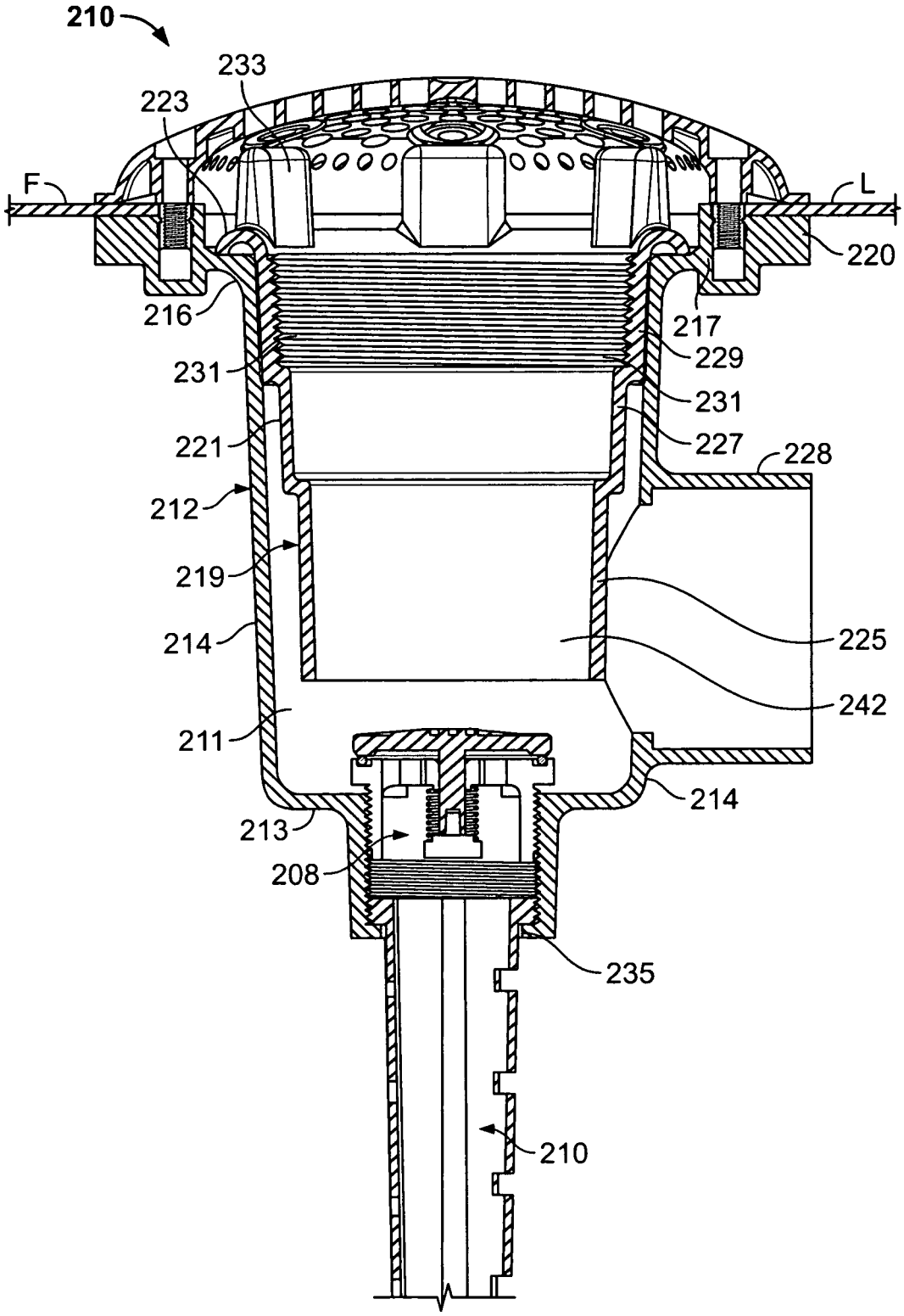
FIG. 7 is a cross-sectional view of a suction outlet assembly which has been constructed in accordance with a second embodiment of the present invention and which includes a removable cover, a hydrostatic relief valve, and a collector tube.
Figure 8:
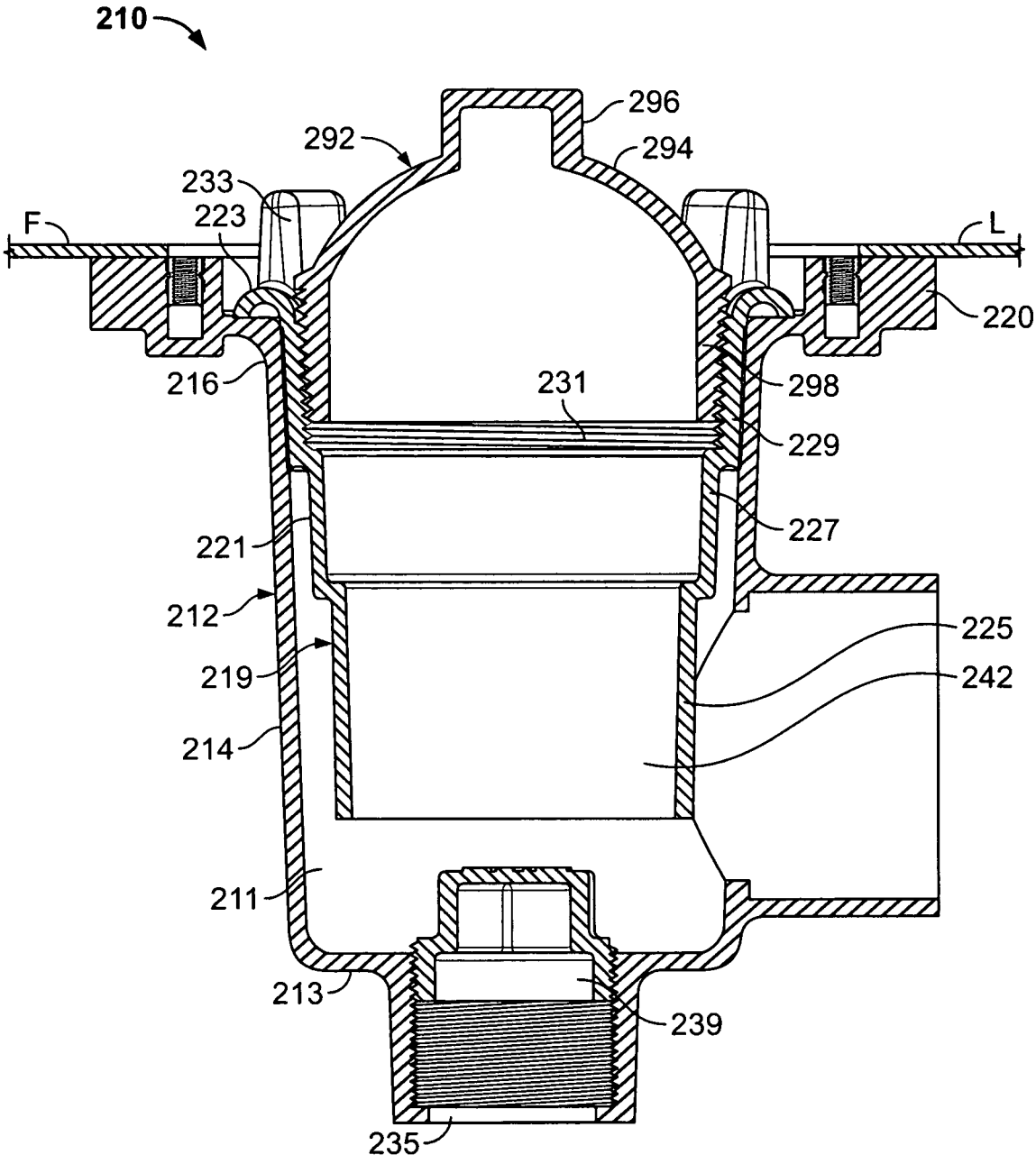
FIG. 8 is a cross-sectional view similar to that of FIG. 7, except that the cover has been removed and replaced by a hydrostatic pressure test cap, and the hydrostatic relief valve and the collector tube have been removed and replaced by a plug.

A second exemplary embodiment of the present invention is illustrated in FIGS. 7 and 8. Elements illustrated in FIGS. 7 and 8 which correspond to the elements described above with reference to FIGS. 1-6 have been designated by corresponding reference numerals increased by two hundred. In addition, elements illustrated in FIGS. 7 and 8 which do not correspond to the elements described above with reference to FIGS. 1-6 have been designated by odd numbered reference numerals starting with reference number 211. The embodiment of FIGS. 7 and 8 operates in the same manner as the embodiment of FIGS. 1-6, unless it is otherwise stated.

FIGS. 7 and 8 illustrate a suction outlet assembly 210 which includes a cup-shaped sump body 212 with a chamber 211 formed in the sump body 212. The sump body 212 also includes an outer wall 214 having an upper end 216 and a bottom wall 213. The sump body 212 has an annulus 217 that extends between the upper end 216 of the outer wall 2.14 and the flange 220. A nozzle 228 is formed in the outer wall 214 of the sump body 212.

Referring to FIGS. 7 and 8, the suction outlet assembly 210 also includes a shroud 219 having a cylindrical, elongated wall 221 which is positioned generally concentrically relative to the outer wall 214 of the sump body 212. The shroud 219 includes a rim 223 sized and shaped so as to be supported on the annulus 217 of the sump body 212. The wall 221 of the shroud 219 includes a lower section 225, an intermediate section 227, and an upper section 229. The lower section 225 of the shroud 219 is positioned to block direct access to the nozzle 228 to prevent limb entrapment in the nozzle 228 and downstream piping. The lower section 225 has a diameter which is less than the diameter of the intermediate section 227, while the intermediate section 227 has a diameter which is less than the diameter of the upper section 229. The upper section 229 is joined through a gluing or welding process to the upper end 216 of the sump body 212 and has internal threads 231 for purposes to be described hereinafter. An interior chamber 242 is formed in the shroud 219, extending along the entire length thereof.

A plurality of external crenellations 233 (three of six are illustrated in FIG. 7) extend from the rim 223 of the shroud 219 and are spaced around the sump body 12. The external crenellations 233 hold a bather away, preventing the formation of a peripheral seal. Like the central stem 30, the shroud 219 prevents limb access to the outlet nozzle 228.

A hydrostatic valve 208 is positioned at the bottom of the sump body 212 so as to close off a hole 235 (see FIG. 8) formed in the bottom wall 213 of the sump body 212. The suction outlet assembly 210 also includes a collector tube 210 positioned below the hydrostatic relief valve 208.

With reference to FIG. 8, a hydrostatic pressure test cap 292 may be mounted to the shroud 219 to perform hydrostatic pressure testing of the suction outlet assembly 210. The test cap 292 includes a domed-shaped lid 294, a nut 296 and a skirt 298. The skirt 298 depends from the lid 294 so as to threadedly engage the internal threads 231 (see FIGS. 7 and 8) formed on the shroud 219. When the test cap 292 is mounted to the shroud 219 as shown in FIG. 8, the hydrostatic relief valve 208 and the collector tube 210 are removed and a plug 239 is placed over the hole 235 formed in the sump body 211. The piping may also be tested with the hydrostatic relief valve 208 (see FIG. 7) in place of the plug 239.

It will be understood that the embodiments described herein are merely exemplary and that a person skilled in the art may make variations and modifications without departing from the spirit and scope of the invention. For example, the number of crenellations 233 (see FIG. 7) can vary. The asterisk-shaped pattern of the openings 54 formed in the cover 46 is merely exemplary, and the openings 54 can be arranged in other patterns. All such variations and modifications are to be included within the scope of the invention.

We claim:

1. A suction outlet assembly, comprising:

a sump body including a substantially cylindrical outer wall, an outlet nozzle formed in said outer wall, and an upper flange, and a hollow central stem having an open upper end proximate said upper flange, said central stem disposed within said outer wall so as to form an annular space between said central stem and said outer wall, said annular space communicating with said outlet nozzle and being dimensioned so as to inhibit the insertion of human body parts therein, and a removable plug adapted to engage and seal said open upper end of said central stem, said removable plug preventing passage of fluid through said open upper end of said central stem, said outlet nozzle sized to allow fluid in the annular space to pass out of said sump body through said outlet nozzle, said central stem having a lower end integrally formed with a lower end of said outer wall of said sump body, said lower end of said central stem and said lower end of said outer wall of said sump body formed from the same material.

2. The suction outlet assembly of claim 1, wherein the removable plug is solid.

3. The suction outlet assembly of claim 1, wherein the removable plug is sized to completely cover the open upper end of said central stem.

4. The suction outlet assembly of claim 1, wherein said lower end of said central stem curves outwardly toward said sump body.

5. The suction outlet assembly of claim 4, wherein said central stem and said outer wall of said sump body cooperate to form a closed bottom.

6. The suction outlet assembly of claim 1, wherein said removable plug prevents passage of fluid from a swimming pool through said open upper end of said central stem while fluid passes through the annular space.

7. The suction outlet assembly of claim 1, wherein said lower end of said central stem and said lower end of said outer wall of said sump body are positioned below said outlet nozzle.

8. A suction outlet assembly, comprising a. a sump body that includes:

i. a substantially cylindrical outer wall, ii. an outlet nozzle formed in the outer wall, and iii. an upper flange, and b. a hollow central stem that defines an open upper end proximate to the upper flange, wherein the hollow central stem is configured within the outer wall so as to form an annular space relative to the outer wall, the annular space communicating with the outlet nozzle; and wherein the annular space is dimensioned so as to inhibit receipt of human body parts therein; and a removable plug adapted to engage and seal said open upper end of said central stem, said removable plug preventing passage of fluid through said open upper end of said central stem, said outlet nozzle sized to allow fluid in the annular space to pass out of said sump body through said outlet nozzle, said central stem having a lower end integrally formed with a lower end of said outer wall of said sump body, said lower end of said central stem and said lower end of said outer wall of said sump body formed from the same material.

* * * * *